US011152152B2

(12) United States Patent
Thomas et al.

(10) Patent No.: US 11,152,152 B2
(45) Date of Patent: Oct. 19, 2021

(54) FABRICATION PROCESS TO PRODUCE A TOROIDAL CURRENT TRANSFORMER

(71) Applicant: Schweitzer Engineering Laboratories, Inc., Pullman, WA (US)

(72) Inventors: Mark A. Thomas, Pullman, WA (US); Eric Ryan, Spokane, WA (US); David Kenny, Pullman, WA (US)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 255 days.

(21) Appl. No.: 16/207,572

(22) Filed: Dec. 3, 2018

(65) Prior Publication Data

US 2020/0176182 A1 Jun. 4, 2020

(51) Int. Cl.

| | |
|---|---|
| ***H01F 41/02*** | (2006.01) |
| ***H01F 38/20*** | (2006.01) |
| ***H01F 30/16*** | (2006.01) |
| ***H01F 41/06*** | (2016.01) |
| ***H01F 27/24*** | (2006.01) |
| ***H01F 27/40*** | (2006.01) |
| ***H01F 27/02*** | (2006.01) |
| ***H01F 27/28*** | (2006.01) |

(52) U.S. Cl.

CPC ..... *H01F 41/02* (2013.01); *H01F 27/02* (2013.01); *H01F 27/24* (2013.01); *H01F 27/28* (2013.01); *H01F 27/40* (2013.01); *H01F 30/16* (2013.01); *H01F 38/20* (2013.01); *H01F 41/026* (2013.01); *H01F 41/0253* (2013.01); *H01F 41/0266* (2013.01); *H01F 41/0286* (2013.01); *H01F 41/06* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,453,726 A * | 7/1969 | Roen | ..... | H01F 27/2455 29/605 |
| 3,465,273 A * | 9/1969 | Brock | ..... | H01F 30/16 336/62 |
| 4,456,873 A | 6/1984 | Schweitzer | | |
| 4,635,055 A | 1/1987 | Fernandes | | |
| 4,782,582 A * | 11/1988 | Venezia | ..... | H01F 41/02 29/605 |

(Continued)

FOREIGN PATENT DOCUMENTS

| | | | | |
|---|---|---|---|---|
| WO | WO-2014072063 A1 * | 5/2014 | ..... | H01F 38/14 |
| WO | WO-2015136910 A1 * | 9/2015 | ..... | G01R 15/186 |
| WO | 2015157296 | 10/2015 | | |

*Primary Examiner* — Peter Dungba Vo
*Assistant Examiner* — Jeffrey T Carley
(74) *Attorney, Agent, or Firm* — Bradley W. Schield

(57) ABSTRACT

The present disclosure relates to a fabrication process for a current transformer. For example, the process may include wrapping first windings around a first core half of a magnetic core of a current transformer. The process may include wrapping second windings around a second core half of the magnetic core. The magnetic core may be inserted into an overmold tool. The process may include overmolding a first overmold over the first core half of the magnetic core and a second overmold over the second core half of the magnetic core. After overmolding, the magnetic core may be cut in half.

9 Claims, 8 Drawing Sheets

(56) References Cited

U.S. PATENT DOCUMENTS 5,165,162 A * 11/1992 Charles ..... H01F 17/062 29/605
5,483,215 A 1/1996 Mies
5,537,089 A * 7/1996 Greif ..... H01F 27/25 336/12
5,550,476 A 8/1996 Lau
5,565,783 A 10/1996 Lau
5,656,931 A 8/1997 Lau
5,729,125 A 3/1998 Schweitzer
5,889,399 A 3/1999 Schweitzer
5,990,674 A 11/1999 Schweitzer
6,002,260 A 12/1999 Lau
7,227,441 B2 6/2007 Skendzic
7,450,000 B2 11/2008 Gidge
7,474,192 B2 1/2009 Skendzic
7,626,794 B2 12/2009 Swartzendruber
7,795,994 B2 11/2010 Radtke
7,930,141 B2 4/2011 Banting
8,738,318 B2 5/2014 Spillane
9,182,429 B2 * 11/2015 Saxby ..... G01R 15/142
9,229,036 B2 1/2016 Kast
9,448,257 B2 9/2016 Saxby
9,838,896 B1 * 12/2017 Barnickel ..... H04W 4/026
9,915,680 B2 3/2018 Khoshnood
9,954,354 B2 4/2018 Baker
9,984,818 B2 5/2018 Rumrill
2005/0237146 A1 * 10/2005 Hirzel ..... H01F 27/25 336/212
2006/0279910 A1 12/2006 Gunn
2008/0077336 A1 3/2008 Fernandes
2009/0115403 A1 * 5/2009 Bernklau ..... H01F 38/30 324/127
2009/0309754 A1 12/2009 Bou
2010/0085036 A1 * 4/2010 Banting ..... G01R 19/2513 324/127
2011/0025444 A1 * 2/2011 Sugiyama ..... H01F 41/06 336/212
2020/0335276 A1 * 10/2020 Na ..... H01F 1/15308

* cited by examiner

FABRICATION PROCESS TO PRODUCE A TOROIDAL CURRENT TRANSFORMER

TECHNICAL FIELD

The present disclosure relates generally to current transformers and, more particularly, to a fabrication process for a split core current transformer.

BRIEF DESCRIPTION OF THE DRAWINGS

Non-limiting and non-exhaustive embodiments of the disclosure are described herein, including various embodiments of the disclosure with reference to the figures listed below.

DETAILED DESCRIPTION OF SPECIFIC EMBODIMENTS

Figure 1:
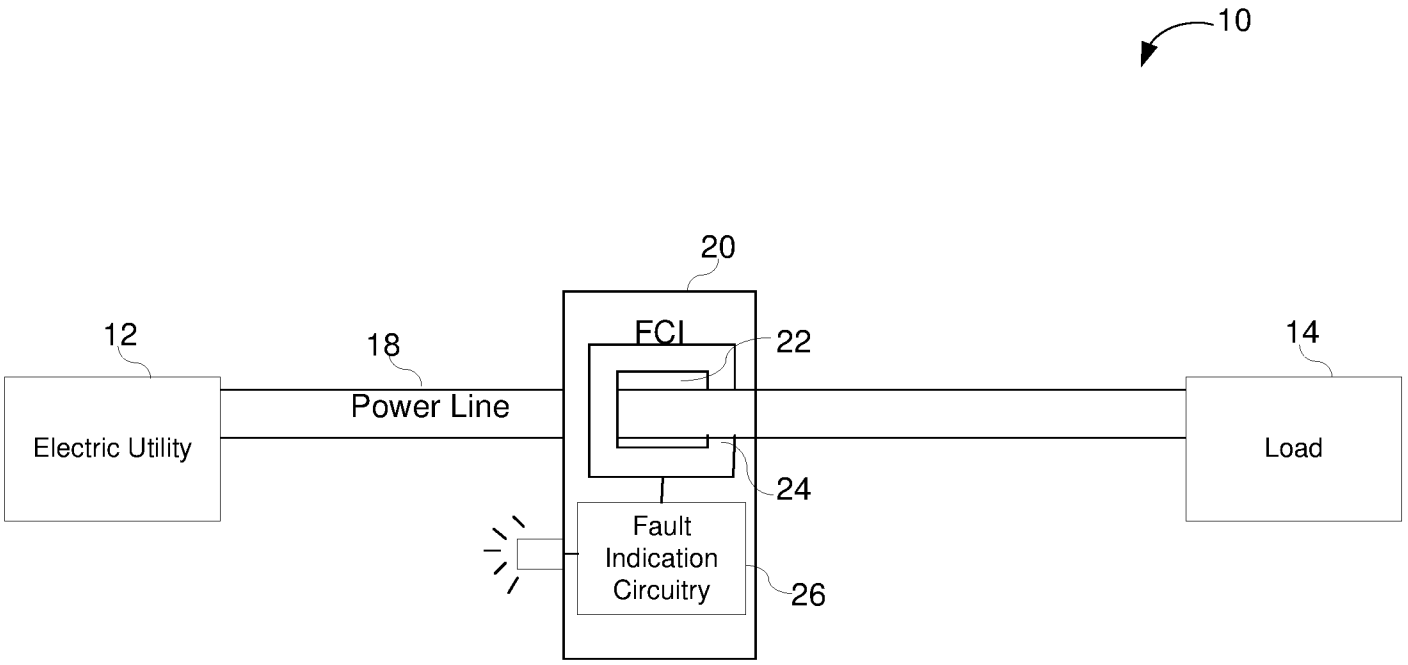
FIG. 1 illustrates a block diagram of an electric power delivery system having a faulted circuit indicator (FCI) that uses a current transformer (CT) to measure current and/or to harvest power from a power line, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Electric power delivery systems are used to transmit and distribute electric power from electric power generation sources to loads, which may be close or distant from the generation sources. Such systems may include generators or other sources, transformers step up or down voltages, transmission lines, buses, distribution lines, voltage regulators, capacitor banks, reactors, circuit breakers, switches, and other such equipment. Electric power delivery equipment may be monitored, automated and/or protected using intelligent electronic devices (IEDs).

IEDs, such as faulted circuit indicators (FCIs), may use current transformers (CTs) to detect current and/or harvest power from conductors, such as power lines, of the electric power delivery system. The CT may include windings and a ferromagnetic toroidal core. The current on the conductor may create a magnetic field in the toroidal core that induces current in the windings proportional to the current on the conductor. The IED may measure the current on the conductor using the CT as well as operate using power harvested from the induced current. By monitoring current on various conductors of electric power delivery systems via CTs, the power delivery system may deliver power in a more reliable manner.

To couple the CT to a conductor, the core may be split into two portions, or halves. The first core half may be contained in a first housing and the second core half may be contained in a second housing. In some embodiments, the housings may be made of plastic to protect and secure the electric and magnetic components within the CT. The first housing and the second housing may be rotatably coupled such that the first core half and the second core half contact each other to allow magnetic flux to flow through the toroidal core when in the closed position.

However, the CT may not operate effectively if there is insufficient contact area between the faces of each half of the core when in the closed position. For example, the core halves of the CT may each be enclosed in an overmold during the fabrication process of the CT to ensure that the windings of the CT are secured to the core halves and to secure the core halves within the housings of the CT. During the overmolding process, the split halves may fall out of alignment. For instance, if either half were to tip out of alignment during the mold process, it may be more difficult to obtain sufficient face to face contact for power harvesting and/or current sensing of the CT. Further, the core halves may become flipped with respect to each other during the mold process, which may cause misalignment in the core halves that result in reduced contact. Accordingly, there is a need to prevent misalignment between the core halves during the fabrication process to ensure sufficient contact between the core faces of the CT to perform current sensing and/or power harvesting operations.

As described below, the CT may be fabricated such that the magnetic core of the CT is cut after the overmold process to prevent misalignment of the core halves in the overmold. For example, the process may begin by winding transformer wire onto a toroidal core. The process may then include attaching lead cables to the ends of the windings. The wound toroidal core may then be placed into an overmold tool. An overmold may then be applied to the toroidal core. The molded CT may then be removed from the overmold tool and allowed to set. After overmolding the toroidal core and waiting a predetermined amount of time for the overmold to set, the CT may then be cut in half. By molding the CT as a single piece and waiting until after the overmolding process to cut the CT, the core halves of the CT may be fabricated in alignment with each other.

FIG. 1 illustrates a block diagram of an electric power delivery system 10 having a source, such as an electric utility 12 that generates power to deliver electrical energy to a load 14 via one or more conductors, such as an overhead power line 18. The power line 18 may be any suitable transmission and/or distribution power line.

The electric power delivery system 10 may include a faulted circuit indicator (FCI) 20 having a current transformer (CT) 24 that encloses a portion of power line 18 via an opening 22 and secures the FCI 20 to the portion of the power line 18. The CT 24 may have coiled wire around a magnetic core to inductively measure alternating current (AC) through the power line 18. The FCI 20 may include fault detection circuitry 26 that receives a signal from the CT 24 and monitors the power line 18 for events. Note that any suitable electric power delivery system may be used in accordance with embodiments described herein and may include any suitable configuration of utilities, loads, transformers, power lines, and other various electrical components.

The fault detection circuitry 26 may be embodied as a general purpose integrated circuit, an application specific integrated circuit (ASIC), a field programmable gate array (FPGA), and/or other programmable logic devices. In some embodiments, the fault detection circuitry 26 may include one or more processor(s), such as a microprocessor, operatively coupled to a non-transitory computer-readable storage medium, such as memory. The memory may be a repository of one or more executable instructions (e.g., code) to implement any of the processes described herein. The fault detection circuitry 26 may include power harvesting circuitry to harvest power from the received current of the CT 24. The harvested power may be used to power operation of the FCI 20.

The CT 24 may provide a current signal to the fault detection circuitry 26 indicating the current on the power line 18. The fault detection circuitry 26 may then detect an event, such as an overcurrent event or an undercurrent event, on the power line 18. For example, the fault detection circuitry 26 may compare the received current from the CT 24 and compare the current to a threshold current. When the received current exceeds the threshold current, the fault detection circuitry 26 may provide an indication (e.g., via a light emitting diode (LED), via a transceiver, etc.) of the event to allow operators to locate and assess the cause of the event.

Figure 2:
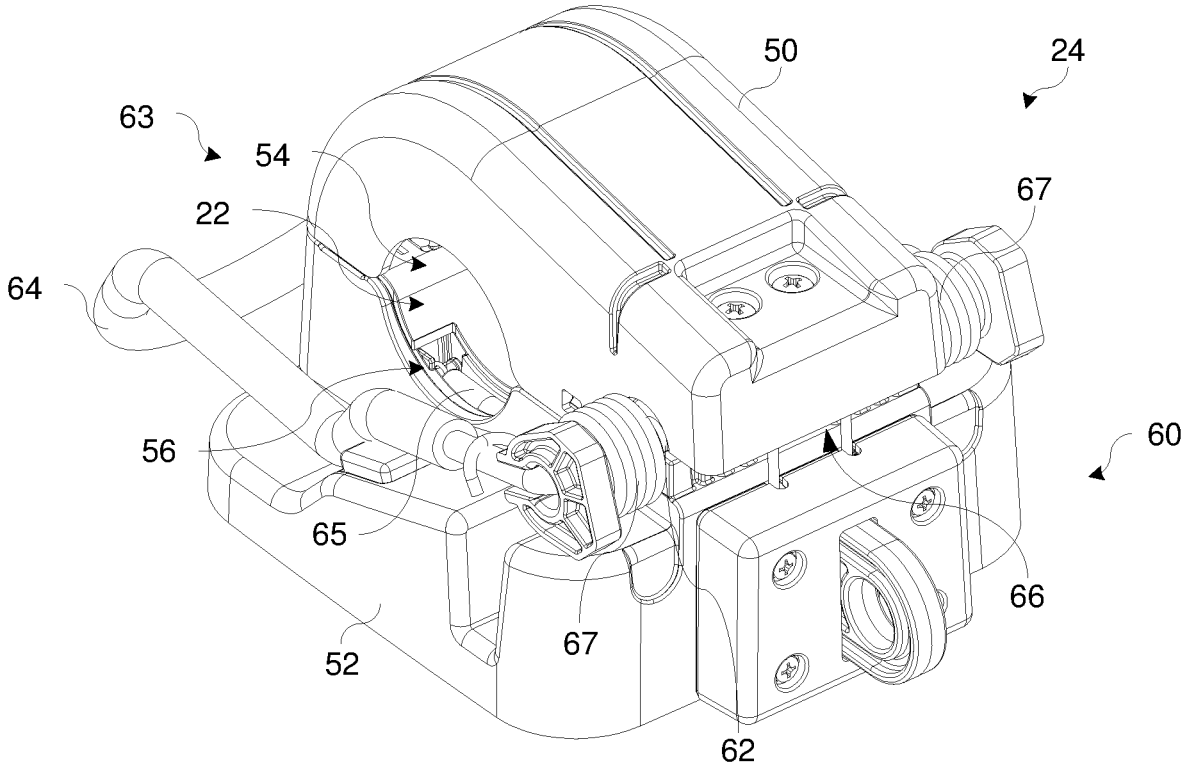
FIG. 2 illustrates a perspective view of the CT of FIG. 1, in accordance with an embodiment.

FIG. 2 illustrates a perspective view of an embodiment of a CT 24 that may be used in the FCI 20. In the illustrated embodiment, the CT 24 includes a first housing 50 and a second housing 52. While in the closed position, as shown in FIG. 2, the first housing 50 and the second housing 52 form an annulus having an opening 22 therebetween to enclose a portion of the power line 18. That is, the first housing 50 includes a first portion 54 (e.g., first semi-cylindrical opening) of the opening 22 and the second housing 52 includes a second portion 56 (e.g., second semi-cylindrical opening) of the opening 22. The first portion 54 and the second portion 56 are contoured to form the opening 22 (e.g., cylindrical opening) to receive a conductor, such as the power line 18. The first housing 50 and the second housing 52 may be rotationally coupled to each other on a first end 60 of the FCI 20 via a hinged connection 62. In other embodiments, the first housing 50 and the second housing 52 may be linearly coupled or coupled in any other suitable manner. The hinged connection 62 may align a second end 63 of the first housing to the second end 63 of the second housing 52 to position the windings annularly and proximate to the power line 18.

In the illustrated embodiment, the FCI 20 includes a clamp bar 64 that guides the power line 18 as the power line 18 is inserted into the opening 22 when in the open position. The FCI 20 has a torsion spring 66 that biases the first housing 50 and the second housing 52 towards each other to the closed position. That is, forces from the torsion spring 66 may maintain the first housing 50 and the second housing 52 in the closed position. Further, a clamp spring 67 or another spring may bias the clamp bar 64 to the closed position. To install the CT 24 to the power line 18, the CT 24 may be propped open with a prop 65. The prop may then be removed to allow the torsion spring 66 close the CT 24 around the power line 18 once the CT 24 is in place. While the clamp bar 64 and the clamp spring 67 are used in the illustrated embodiment, note that any suitable method of opening and closing the FCI 20 around the power line 18 may be used.

Figure 3:
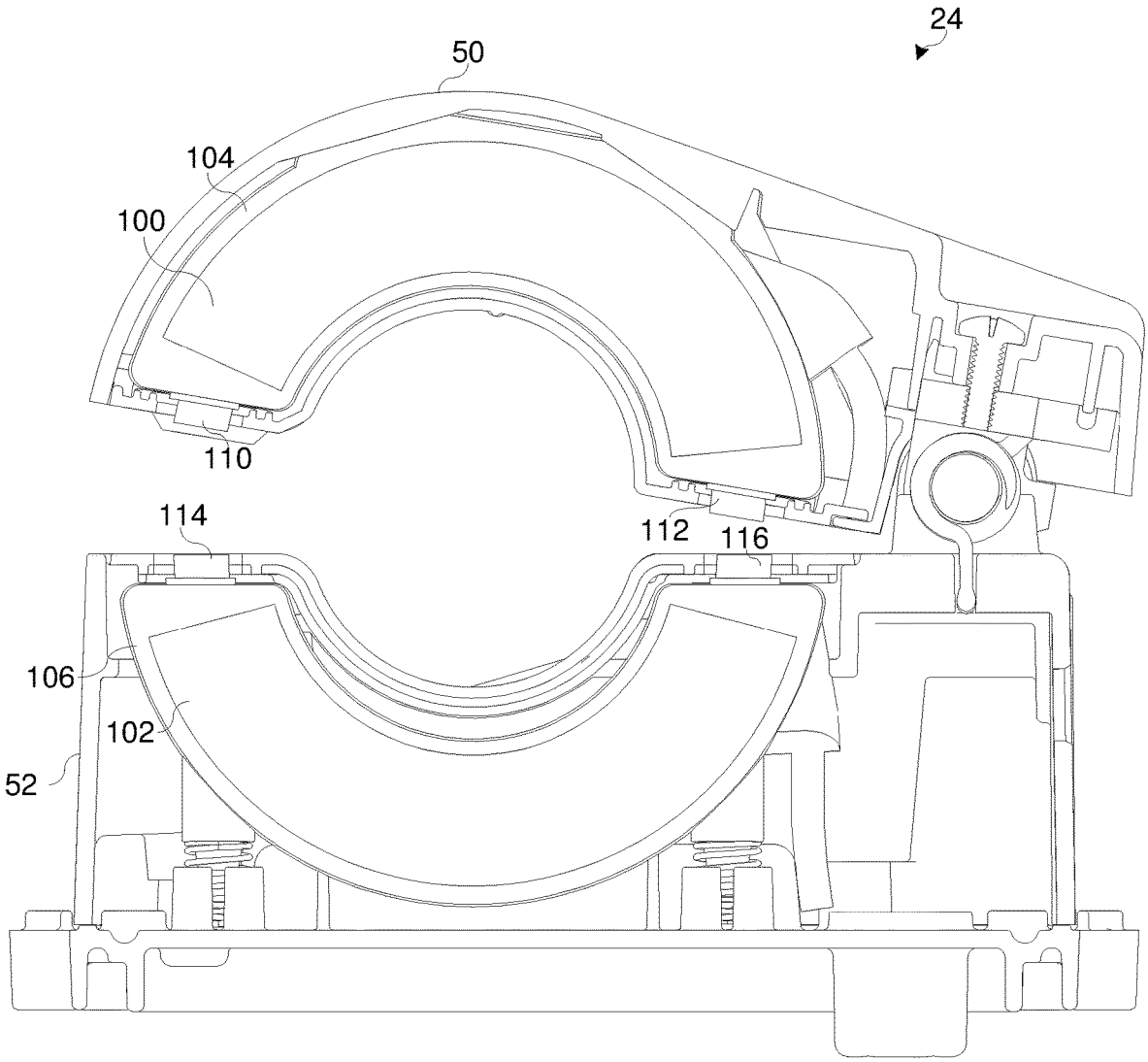
FIG. 3 illustrates a cross-sectional side view of the CT of FIG. 1 in an open position, in accordance with an embodiment.

FIG. 3 is a cross-sectional side view of the CT 24 in an open position, in accordance with an embodiment. As mentioned above, the CT 24 may include windings and a split toroidal core made of, for example, ferromagnetic material. The CT 24 includes the first housing 50 having a first core half 100 and the second housing 52 having a second core half 102. The CT 24 may include windings wrapped around each of the core halves 100 and 102. The windings may be electrically connected to the fault detection circuitry 26 to enable the fault detection circuitry 26 to measure the current on the power line 18.

In the illustrated embodiment, the first core half 100 and the second core half 102 may be enclosed in a first overmold 104 and a second overmold 106, respectively, to secure the windings around the core halves 100 and 102. The first overmold 104 may be inserted into the first housing 50, and the second overmold 106 may be may be inserted into the second housing 52. The first core half 100 may have faces 110 and 112 that extend from the overmold 104 to contact respective faces 114 and 116 of the second core half 102. The faces 110 and 112 of the first core half 100 and the faces 114 and 116 of the second core half 102 contact each other to allow for magnetic flux to pass throughout the split core to induce the current on the windings. However, if the faces 110 or 112 of the first core half 100 do not have sufficient contact area with the faces 114 or 116 of the second core half 102 to allow the magnetic flux to pass throughout the split core, then the CT 24 may not operate effectively. Due to the limited or no current from the CT 24, the CT 24 may not enable current sensing and/or power harvesting capabilities of the FCI.

Figure 4:
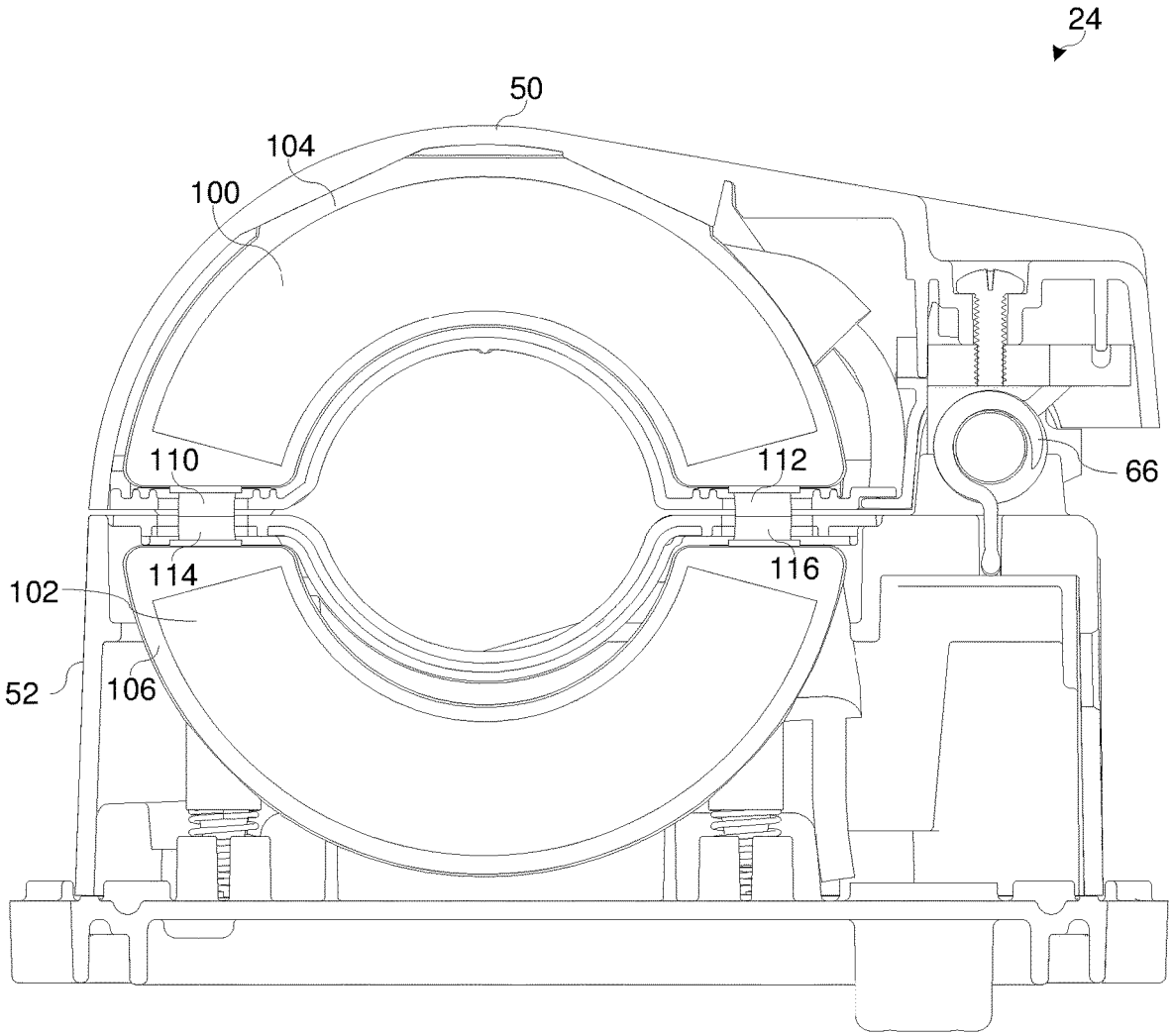
FIG. 4 illustrates a cross-sectional side view of the CT of FIG. 1 in a closed position, in accordance with an embodiment.

FIG. 4 illustrates is a cross-sectional side view of the CT 24 in a closed position, in accordance with an embodiment. As mentioned above, when the core is in the closed position, the faces 110 and 112 of the first core half 100 may contact the faces 114 and 116 of the second core half 102, respectively. By securing the faces together, the second core half 102 of the CT 24 may have sufficient contact to allow magnetic flux to flow across the core faces to allow the CT 24 to sense current and to harvest power from the conductor 18.

Depending on the fabrication process, the first core half 100 and the second core half 102 may become misaligned with each other. For example, if the first core half 100 is tipped out of alignment with the second core half 102 during the overmolding process, the first overmold 104 may misalign the first core half 100 with the second core half 102. To ensure sufficient contact between the faces 110 and 112 of the first core half 100 with the corresponding faces 114 and 116 of the second core half 102, the CT 24 may undergo a fabrication process that involves cutting the magnetic core after the overmolding process.

Figure 5:
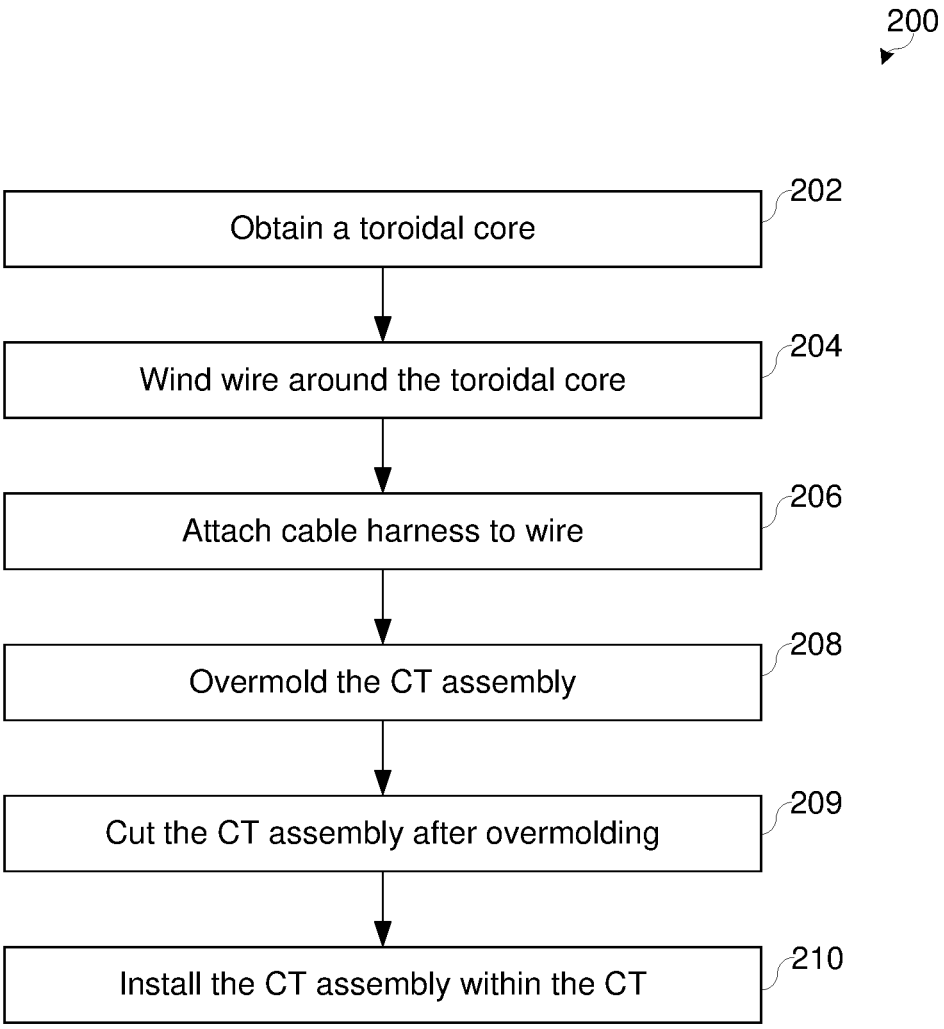
FIG. 5 illustrates a block diagram of a process to fabricate the CT of FIG. 1, in accordance with an embodiment.

FIG. 5 illustrates a flow chart of a fabrication process 200 to produce a split toroidal core CT 24, in accordance with an embodiment. The fabrication process 200 is described in conjunction with FIGS. 6-10, which show the state of a CT assembly 212 at various stages of the fabrication process 200. The fabrication process 200 may begin by obtaining a toroidal core (block 202).

Figure 6:
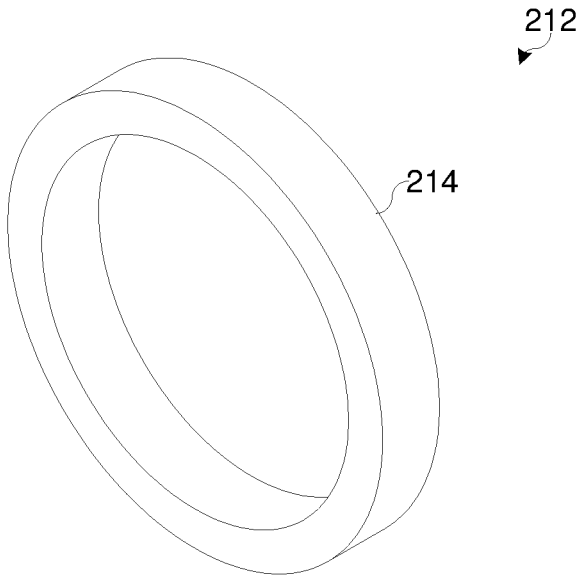
FIG. 6 illustrates a perspective view of a toroidal core of the CT of FIG. 1, in accordance with an embodiment.

FIG. 6 illustrates a perspective view of a toroidal core 214 of a CT assembly 212 that may be used in the CT 24, in accordance with an embodiment. The toroidal core 214 may be obtained as a single piece. The toroidal core 214 may be made of ferromagnetic material that is susceptible to magnetization.

Figure 7:
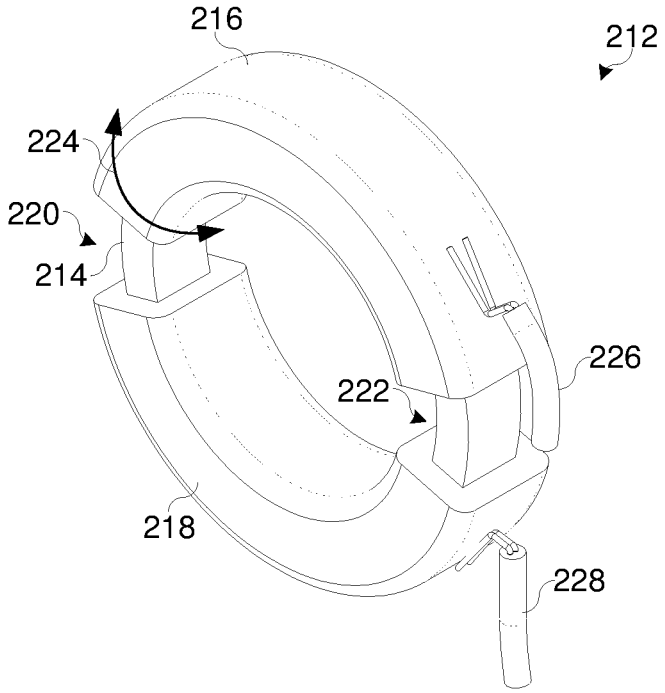
FIG. 7 illustrates a perspective view of the toroidal core of FIG. 6 with lead cables attached to the windings, in accordance with an embodiment.

FIG. 7 illustrates a perspective view of the CT assembly 212 having first windings 216 and second windings 218 of wire wrapped around the toroidal core 214. That is, the first windings 216 and the second windings 218 may be wound around the toroidal core 214 to operate as the secondary windings of the CT 24 (block 204). As explained above, a conductor (i.e., the primary winding(s)) passing through the opening of the toroidal core 214 may induce a current on the secondary windings (e.g., the first windings 216 and the second windings 218) of the CT 24 to allow the FCI 20 to harvest power and/or detect events on the conductor. The first windings 216 may be separated from the second windings 218 by gaps 220 and 222 to allow for gaps in the overmold for subsequently cutting the toroidal core 214. While the first windings 216 and the second windings 218 are shown as a solid block in FIG. 7, this is meant for illustrative purposes, and the first windings 216 and the second windings 218 may be wrapped helically along the toroidal core 214 as indicated by arrows 224.

Upon wrapping the first windings 216 and the second windings 218 of wire around the toroidal core 214, lead cables 226 and 228 may be attached to the first windings 216 and the second windings 218, respectively (block 206). The lead cables 226 and 228 may electrically connect the first windings 216 and the second windings 218 to the fault detection circuitry 26. As mentioned above, the first windings 216 and the second windings 218 may be held in place by an overmolding of the CT assembly 212. The CT assembly 212 may be inserted into an overmold tool as a single piece to ensure proper alignment of the first core half 100 and the second core half 102 of the CT 24 following the overmold process. The CT assembly 212 may then be removed from the overmold tool once the mold material has set.

Figure 8:
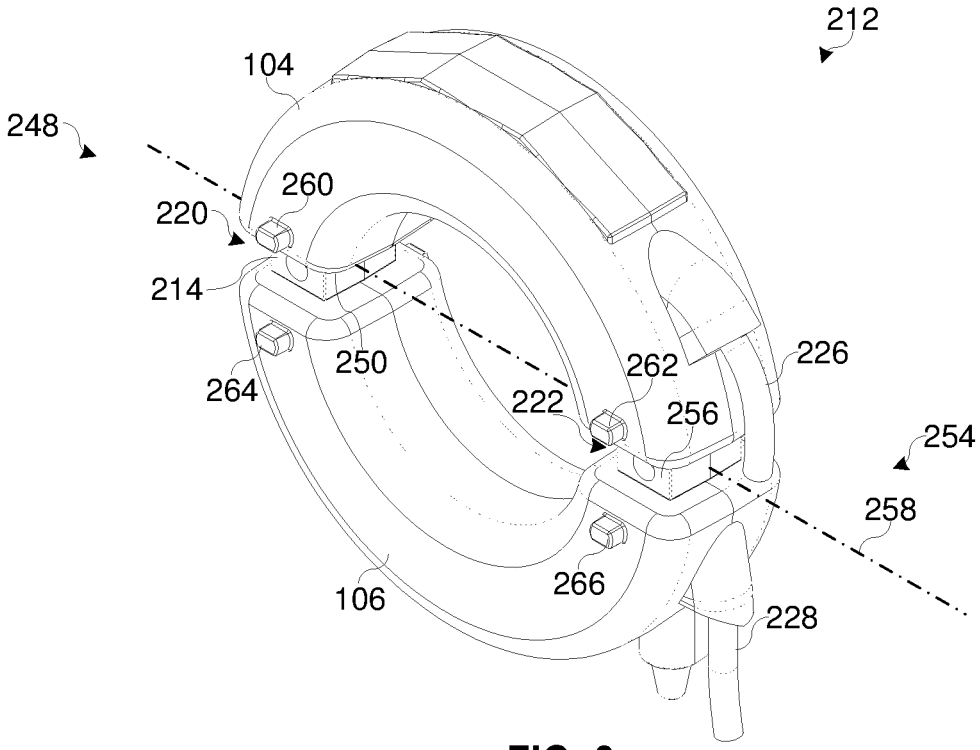
FIG. 8 illustrates a perspective view of the toroidal core of FIG. 6 in an overmold, in accordance with an embodiment.

FIG. 8 is a perspective view of the CT assembly 212 after the overmold process in which the CT assembly 212 is in a pre-cut state. The CT assembly 212 (e.g., the toroidal core 214, the first windings 216, and the second windings 218) may be inserted into an overmold tool, such as a mold cavity, as a single piece for molding the overmold around the toroidal core 214, the first windings 216, and the second windings 218 to secure the windings to the toroidal core 214 (block 208). That is, the toroidal core 214 of the CT assembly 212 may be inserted into the overmold tool prior to any cutting of the toroidal core 214 that results in a split core.

In the illustrated embodiment, the overmold tool forms a first overmold 104 over the first core half 100 and the first windings 216 to secure the first windings 216 to the first core half 100. Similarly, the overmold tool forms a second overmold 106 over the second core half 102 and the second windings 218 to secure the second windings 218 to the second core half 102. The CT assembly 212 may have a first gap 220 formed on a first end 248 of the toroidal core 214 that exposes a first section 250 of the toroidal core 214. The CT assembly 212 has a second gap 222 formed on a second end 254 of the toroidal core 214 that exposes a second section 256, opposite the first section 250. That is, the first section 250 and the second section 256 may expose a diameter 258 across the CT assembly 212 to allow a cutting tool to cut the toroidal core 214 across the diameter 258 into two halves. Further, the first gap 220 and/or the second gap 222 may be used to hold the CT assembly 212 during the overmolding, which may provide more area for clamping while the toroidal core is a single-piece than if the CT assembly 212 were already cut. Because the CT assembly 212 is inserted into the overmold tool as a single-piece, the first core half 100 and the second core half 102 may be aligned with each other throughout the overmold process.

For example, by cutting the CT assembly 212 after the overmold process, the core halves may be prevented from tipping out of alignment during the mold process. By ensuring that the core halves are aligned during the mold process, the first core half 100 and the second core half 102 of the CT 24 may be better aligned following the cutting process and installation into the housing. Any suitable overmold molding process may be used to form the overmold over the CT assembly 212, such as injection molding, insert molding, and the like.

Further, the overmold may include alignment features to maintain the position of the CT assembly 212 as the CT assembly 212 undergoes the cutting process. For instance, the first overmold 104 may include first alignment features 260 and 262, and the second overmold 106 may include second alignment features 264 and 266 to support the CT assembly 212 during cutting. The CT assembly 212 may then be cut into two halves after the mold has set (block 209).

Figure 9:
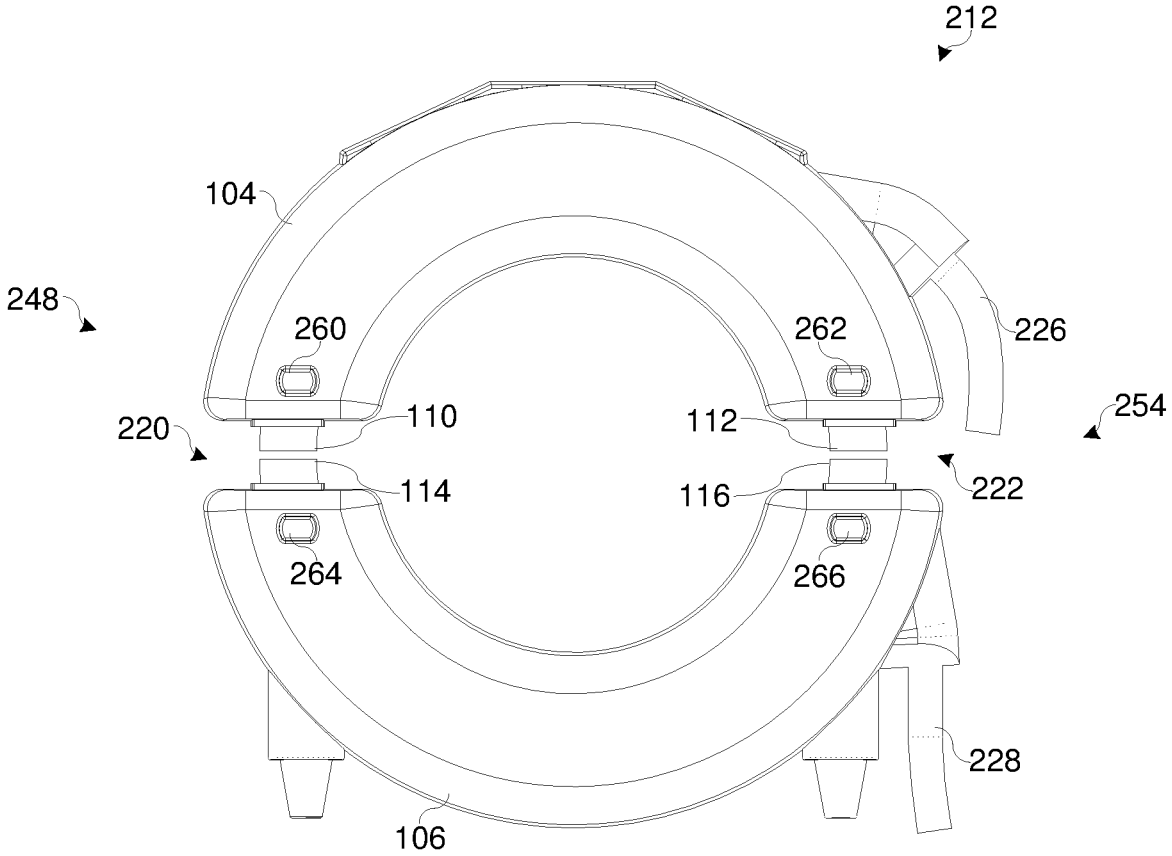
FIG. 9 illustrates a side view of the toroidal core of FIG. 6 cut in half, in accordance with an embodiment.

FIG. 9 is a side view of the CT assembly 212 after cutting the toroidal core 214 of the CT assembly 212 in half. The alignment features 260 and 262 in the first overmold 104 may be used to mount the first core half 100 into the first housing 50. Further, the alignment features 264 and 266 may be used to mount the second core half 102 into the second housing 52. For example, the alignment features 260, 262, 264 and 266 may each be protrusions from the overmold body that match corresponding recessions in the respective housings 50 and 52. Upon cutting the CT assembly 212 in half, the first core half 100 may include faces 110 and 112 that contact respective faces 114 and 116 of the second core half 102.

Figure 10:
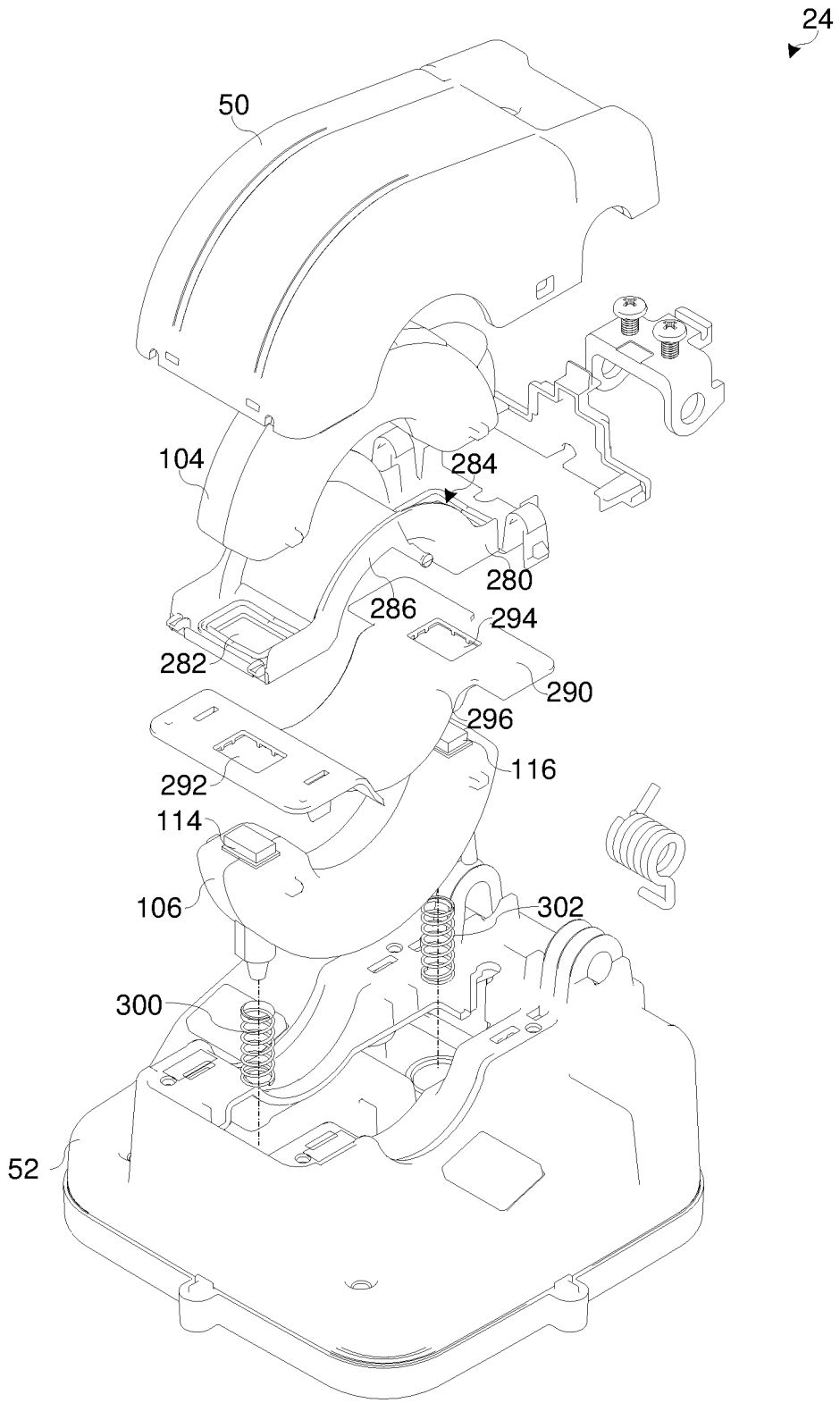
FIG. 10 illustrates an exploded perspective view of the CT of FIG. 1, in accordance with an embodiment.

FIG. 10 is an exploded perspective view of the CT, in accordance with an embodiment. After cutting the CT assembly 212 in half, the first core half 100 and the second core half 102 may be inserted into the first housing 50 and the second housing 52, respectively (block 210). The first overmold 104 may be installed into the first housing 50 within a saddle 280. The saddle 280 may include openings 282 and 284 to allow the faces 110 and 112 to extend from the first housing 50 towards the second core half 102. The saddle 280 may include a body 286 that matches a contour of the first overmold 104 to secure the first core half 100 within the first housing 50. The second housing 52 may include a saddle 290. The saddle 290 includes openings 292 and 294 to allow faces 110 and 112 to extend from the second housing 52 to contact the corresponding faces 114 and 116 of the first core half 100. The saddle 290 has a body 296 that matches a contour of the second overmold 106 to secure the second overmold 106 within the second housing 52.

In the illustrated embodiment, the second housing 52 may include biasing elements 300 and 302, such as compression springs, to bias the faces 114 and 116 towards the faces 110 and 112 to secure contact between each of the faces. While this is used as an example, in other embodiments, the faces

110, 112, 114, and 116 may be secured together via press-fit or from rotation of the torsion spring.

By keeping the toroidal core 214 whole, as a single piece, until after the overmolding, the amount of misalignment of the core halves due to the other process steps may be minimized. For example, by waiting until after the overmolding to cut the toroidal core 214 of the CT assembly 212, misalignment between the halves of the toroidal core 214 (e.g., due to turning one half around) may be minimized.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A method, comprising:

wrapping first windings around a first core half of a magnetic core of a current transformer;

wrapping second windings around a second core half of the magnetic core;

after wrapping the first windings around the first core half and the second windings around the second core half, inserting the magnetic core into an overmold tool;

overmolding a first overmold over the first core half of the magnetic core and the first windings and a second overmold over the second core half of the magnetic core and the second windings, wherein the first overmold and the second overmold secure the first core half and the second core half within housings of the current transformer, wherein overmolding the first core half and the second core half while the magnetic core is a single piece ensures alignment of the first core half with the second core half throughout the overmold process; and after overmolding, cutting the magnetic core in half.

2. The method of claim 1, comprising waiting for a mold material to set prior to cutting the magnetic core in half.

3. The method of claim 1, comprising maintaining a position of the magnetic core using alignment features on the overmold to cut the magnetic core in half.

4. The method of claim 3, comprising installing the first core half within a first housing of a faulted circuit indicator (FCI) by engaging a first set of the alignment features with corresponding recesses of the first housing.

5. The method of claim 4, comprising installing the second core half of the current transformer (CT) within a second housing of a faulted circuit indicator (FCI), different from the first housing, by engaging a second set of the alignment features with corresponding recesses of the second housing.

6. The method of claim 1, wherein overmolding the magnetic core comprises molding a cavity that forms a first gap on a first end between the first core half and the second core half and a second gap on a second end, opposite the first end, between the first core half and the second core half to allow cutting across a diameter of the magnetic core.

7. The method of claim 1, comprising electrically connecting the current transformer (CT) to fault detection circuitry via lead cables attached to ends of the first windings and the second windings of the CT.

8. A method, comprising:

wrapping first windings around a first core half of a magnetic core of a current transformer;

wrapping second windings around a second core half of the magnetic core;

inserting the magnetic core into an overmold tool after wrapping the first windings around the first core half and the second windings around the second core half;

upon inserting the magnetic core into the overmold tool, overmolding a first overmold over the first core half of the magnetic core and a second overmold over the second core half of the magnetic core with a first gap on a first end between the first core half and the second core half and a second gap on a second end, opposite the first end, between the first core half and the second core half to allow cutting across a diameter of the magnetic core within the first gap and the second gap, wherein the first overmold and the second overmold secure the first core half and the second core half of the magnetic core within housings of the current transformer, and wherein overmolding the first core half and the second core half while the magnetic core is a single piece ensures alignment of the first core half with the second core half throughout the overmold process;

after overmolding, cutting the magnetic core in half across the diameter of the overmold.

9. A method, comprising:

wrapping first windings around a first core half of a magnetic core of a current transformer;

wrapping second windings around a second core half of the magnetic core;

after wrapping the first windings around the first core half and the second windings around the second core half, inserting the magnetic core into an overmold tool;

overmolding a first overmold over the first core half of the magnetic core and a second overmold over the second core half of the magnetic core while the magnetic core is a single piece to ensure alignment of the first core half with the second core half throughout the overmold process, wherein the first overmold and the second overmold secure the first core half and the second core half within housings of the current transformer;

after overmolding, cutting the magnetic core in half.

* * * * *